United States Patent [19]

Thimm

[11] 4,187,802

[45] Feb. 12, 1980

[54] DEVICE FOR APPLYING FLOWING MASSES TO THE SURFACE OF A WORKPIECE

[76] Inventor: Max Thimm, Rhienscher Berg 10, D-5810 Witten, Fed. Rep. of Germany

[21] Appl. No.: 837,045

[22] Filed: Sep. 23, 1977

[30] Foreign Application Priority Data

Sep. 25, 1976 [DE] Fed. Rep. of Germany ..... 2643279
Sep. 14, 1977 [DE] Fed. Rep. of Germany ..... 2741239

[51] Int. Cl.[2] ..... B05C 1/00

[52] U.S. Cl. ..... 118/708; 118/406; 401/148

[58] Field of Search ..... 118/3, 406, 708; 401/148, 150, 172, 173; 101/114

[56] References Cited

U.S. PATENT DOCUMENTS

| | | | |
|---|---|---|---|
| 548,572 | 10/1895 | Miller | 401/148 |
| 1,315,305 | 9/1919 | Hegland | 401/148 |
| 3,372,638 | 3/1968 | Tripp | 101/114 |

*Primary Examiner*—John P. MacIntosh
*Attorney, Agent, or Firm*—Haseltine, Lake & Waters

[57] ABSTRACT

A device for applying flowing masses to a surface which includes a conduit which feeds the mass to the rear side of a piston mounted for reciprocation in a chamber. The piston has openings therethrough and serves to apply coating to the surface by reciprocation in the chamber.

6 Claims, 2 Drawing Figures

DEVICE FOR APPLYING FLOWING MASSES TO THE SURFACE OF A WORKPIECE

Figure 1:
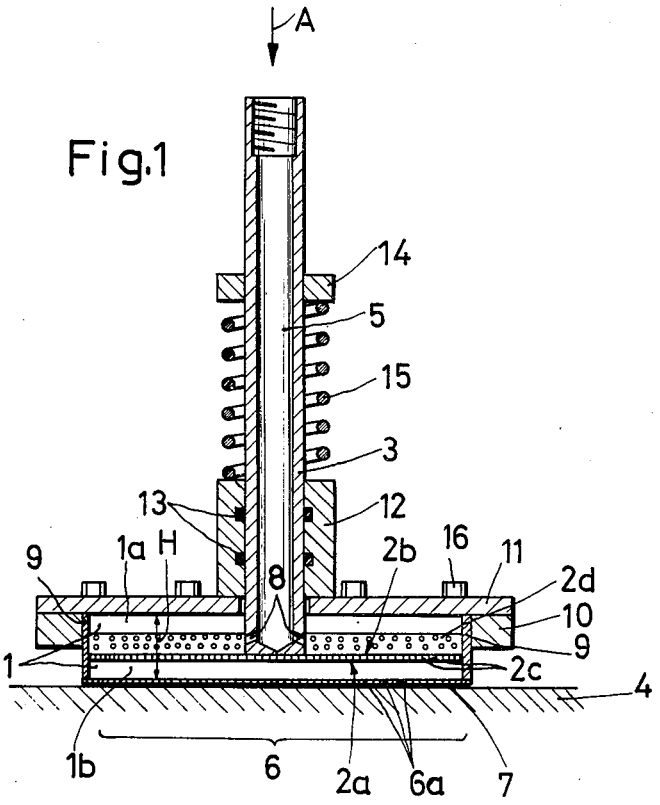

The invention relates to a device for applying flowing masses, such as pastes or viscous liquids, to the surface of a workpiece, whereby the mass is contained in a chamber, to which the mass is conveyed through a conduit and which has an outlet turned to the surface of the workpiece.

It is known to apply adhesive punctiformly to the surface of a workpiece by means of a nozzle-like device. This known device has a chamber with an outlet turned towards the surface of the workpiece, said outlet having a smaller cross-section than that of the chamber. The chamber placed in the place to be provided with adhesive with its outlet discharging onto the surface of the workpiece so that adhesive issuing from the outlet adheres to the surface of the workpiece. While the device is being raised from the surface of the workpiece a greater or lesser amount of adhesive is drawn out of the chamber until filaments are formed. It is not possible to keep the applied amount constant and the adhesive layer remaining on the surface of the workpiece is of uneven thickness, i.e. it is thicker in the central area than at the edges. It is not possible to achieve a securely adhering layer which is of even thickness and quantity on very smooth surfaces or surfaces which have not been freed from oil, and, moreover, drops may issue from the device when in raised position, depending on how low the viscosity of the mass is and soil the surface of the workpiece.

The object of the invention is to provide a device of the aforementioned type which applies a layer of even thickness and quantity so that it securely adheres to surfaces of workpieces.

This object is solved according to the invention in that a piston is arranged in the chamber, through the front side of which piston the mass is forced towards the outlet that the front side of the piston is parallel to the outlet and that the piston has passages through which one part of the mass reaches the rear side of the piston.

It is possible to apply free-flowing masses such as pastes or viscous fluids evenly to surfaces of workpiece in exactly dosed amounts by a device constructed in this way, and thereby to avoid filament formation or drops. It is also possible to achieve a securely adhering layer which is of even thickness on greasy or very smooth surfaces or surfaces which have not been freed from oil. Depending on the shape and size of the outlet, exactly formed layers of precisely defined size can be applied to the surfaces; and the device can not only be used for adhesives but also for viscous fluids and pastes of many different types such as fats, dyes, metal binding masses or plastic masses. Moreover, the device according to the invention achieves high working cycle numbers and can also be used on vertical surfaces or on the undersides of workpieces so that, for example, a sheet can be provided with amounts of adhesive or metal binding masses on both its opposing sides at the same time.

With the device according to the invention the piston presses an amount of mass, which has been exactly measured, onto the surface of the material with a precisely defined pressure so that the mass is securely adhered to the surface of the workpiece. More mass than the amount positioned in front of the piston can not be drawn out of the chamber and thus an even application is achieved. In the case of masses which are particularly difficult to adhere or of surfaces which accept the mass with particular difficulty, the piston can move up and down several times while the device is being placed upon the workpiece in order to press against the mass several times. An exact dosage of the respective mass can not only be achieved by supplying a measured amount of this mass to the device but also by a part of the excess mass supplied reaching the rear side of the piston through passages in the piston and moving forward partly or completely through the piston again only in the case of a reverse movement of the piston. It is possible hereby not only to balance out the shortage or excess of mass on the front side of piston if this should occur, but the mass is distributed evenly over the entire surface of the piston, also on the rear side of the piston so that an even discharge to the front surface of the piston is achieved and with it an even application. Larger surfaces can be coated with mass by lining up several devices close together.

It is indeed known per se from the German Pat. No. 1,000,259 to arrange a piston in a chamber in a device for applying adhesive, however the piston herein is not a part which forces the adhesive towards the outlet, but a sealing body of a valve.

It is proposed in a preferred embodiment of the invention that the piston should be in the form of a disc and have several openings to serve as passages. A disc-type piston not only saves space but also permits the mass to pass easily through the piston and can be simply cleaned. The piston can be formed from a plate or sheet which is perforated in the way of a sieve. A piston composed of a sieve is particularly simple to produce.

The passages need not only be arranged inside the piston but can also be formed from recesses or grooves positioned approximately axis parallel on the side surfaces of the piston.

It is further proposed that in order to decrease the cross-sectional surface of the outlet the latter is subdivided into several openings and/or slots. A material, which is permeable for the mass, in particular a fabric or sieve, can be arranged in the outlet. Such an outlet which throttles the mass leads to a chamber section being formed between the front surface of the piston and the outlet, out of which chamber section the piston must press the mass out against the resistance of the throttling cross-section so that only the mass passing through the outlet reaches the surface of the workpiece. Not only is the amount to be applied exactly determined hereby, but this also prevents mass from being drawn out of the device or being drawn off from the surface through the device while the device is being raised from the surface (reverse suction effect). Moreover, the part of the chamber in front of the piston additionally distributes the mass so that the latter can issue from the device being with certainty evenly distributed.

In a further embodiment of the invention it is proposed that the mass is introduced into the part of the chamber which is positioned on the rear side of the piston. The mass thereby enters first into the back part of the chamber, is here distributed over the surface of the piston and, only after that, is pressed towards the front side of the piston so that the mass is evenly distributed on the front side of the piston.

In order to guarantee still more surely that a constant amount is applied, it is proposed that the mass be supplied to the chamber through a dosing device. A particularly simple and space-saving construction method is achieved by forming the conduit which supplies the mass from a longitudinal boring in the piston rod. Transverse borings, which connect the longitudinal boring to the part of the chamber which is positioned on the rear side of the piston, can be arranged in the piston rod adjacent the rear side of the piston.

As the dimensions of the chamber are of great importance for even distribution of the mass in the chamber, it is proposed that the height of the chamber should be less than the latter's diameter or than the latter's expansion parallel to the outlet.

The piston and the chamber do not need to have a circular cross-section but they may have the dimensions the mass which is to be applied to the surface should have so that the piston and the chamber may have a rectangular cross-section corresponding to each other.

An embodiment of the invention is represented in the drawing and explained in more detail below.

Figure 2:
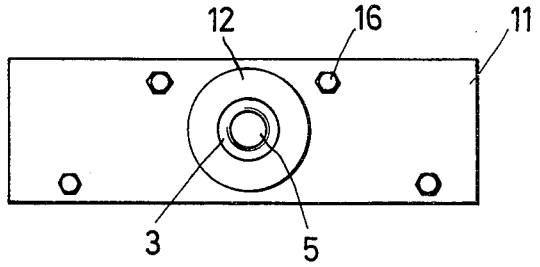

FIG. 1 shows a section through the device along the length of the axis of the piston rod, and FIG. 2 shows a top view onto the device in the direction of arrow A.

The device according to the invention may be named an application nozzle and has a rectangular sheet (sieve, punched screen) provided with many holes (passages 2*c*), which is bent up on both opposing longitudinal sides to form edges 2*d* and forms a piston 2 (sieve piston). A tube or hollow rod, which forms a conduit 5, is soldered on at right angles in the middle of this sheet or piston on one side to serve as a piston rod 3. The piston rod 3 is closed on the side to which the piston rod 3 is secured to the piston 2 and has two transverse borings 8 which provide a connection between the conduit 5 and the area on the rear side of the piston at a short distance from the rear side 2*b* of the piston. The piston 2 is arranged in a rectangular chamber 1, the cross-section of which corresponds to that of the piston and the side walls of which are formed by four sheets 9 which are soldered onto one of the frames 10 surrounding the chamber. These sheets 9 form an outlet 6 on the opposite front side, said outlet 6 being turned towards the surface of a workpiece 4 and arranged parallel thereto, and a sieve 7 with openings 6*a* is soldered onto said outlet 6 in the embodiment shown in FIG. 1. Instead of having a sieve the outlet 6 can be subdivided into several single openings or slots which act in a similar manner to the sieve in decreasing the cross-section of the outlet. In the case where the piston and the chamber have a circular cross-section, the chamber can be characterized as a cylinder.

A plate 11 is screwed onto the frame 10 by means of screws 16. The plate 11 also has a coaxial outlet for the piston rod 3 and a coaxially welded on bushing 12, through which the piston rod 3 passes and which is sealed by two ring seals 13. A ring 14 is secured on the outside of the piston rod 3 at a distance from the bushing 12. A coaxial pressure spring 15, which is supported on the ring 14 and the bushing 12 and is to press the piston rod 3 and the piston 2 away from the outlet 6, is positioned on the piston rod 3.

The chamber 1 formed by the sheets 9, the plate 11 and the sieve 7 is divided by the piston 2 into a first rear chamber part 1*a* and a second front chamber part 1*b*. As the size and shape of the outlet 6 determine the size and shape of the mass to be applied and the outlet 6 forms the floor surface of the chamber 1, the size of the chamber 1 depends on the size and shape of the application desired. The shape and size of the application mass can admittedly be changed by screens or masks secured to the sieve 7 on the outside which are not shown or represented. In FIG. 1 the chamber 1 is cut along the length of the greatest extension so that it is considerably shallower than the width shown in FIG. 1 in order to achieve an application of mass in the form of a narrow strip on the surface of the workpiece. The chamber 1 has a relatively low height H in relation to its width in order to achieve an even distribution of the mass in the chamber 1 with relatively little movement of the piston.

In an alternative embodiment which is not shown in the drawing no sieve 7 is arranged in the outlet 6 so that when the device is lying on the workpiece 4 the chamber 1 is not closed off by the sieve 7 but by the workpiece 4.

In a further alternative embodiment which is not shown in the drawing, axis parallel recesses or grooves can be moulded in the side surfaces of the piston which abut the side walls 9 of the chamber, said recesses or grooves providing a connection between the parts 1*a* and 1*b* of the chamber in addition to or in place of the passages 2*c*.

The device works as follows: it is positioned with its outlet 6 on the surface of a workpiece 4 and mass of medium or high viscosity, e.g. adhesive, fat, dye, metal binding mass, plastic mass, is pressed into the conduit 5 in the direction of the arrow A by a dosing device (not represented) and passes into the chamber part 1*a* through the transverse borings 8. The mass is distributed in the chamber part 1*a* by the piston moving in the opposite direction to that of the arrow A and, subsequent to its being distributed, is at least partly pressed on further movement of the piston in the same direction through the passages 2*c* of the piston to the front side 2*a* of the piston and into the chamber part 1*b*. As the mass was evenly distributed in the chamber part 1*a*, it also passed evenly over the entire surface of the piston through all the passages 2*c* onto the front side 2*a* of the piston so that in the case of no sieve 7 being present and the chamber part 1*b* being closed off by the workpiece 4 the mass is pressed by the piston onto the surface of the workpiece. The intensity of pressure is dependent on the size and number of passages 2*c* or on their throttling effect. In the case where there is a large amount of mass in chamber part 1*b*, an exact dosage of the mass to be applied to the workpiece is guaranteed by the piston, which is now pressing in the direction of the arrow A, allowing the excess mass to flow back through the passages 2*c* into chamber part 1*a*. If the mass is to be particularly securely adhered to the workpiece, the piston can be moved up and down several times.

If a sieve 7 is arranged in the outlet 6, as shown in FIG. 1, whereby the resistance of the sieve 7 being equal to or less than that of the passages 2*c* of the piston, then while the piston is moving in the direction of arrow A the mass will be pressed through the sieve 7 before it hits the surface of the workpiece. In this case the mass is also pressed onto the surface by a high pressure which corresponds to the requirements. While the piston remains in its lower position, in which it touches the sieve 7, the device is raised hydraulically or pneumatically by a cylinder-piston device, which is fastened to the bushing 12 or to the piston rod 3 and subsequently begins a new working cycle in which mass is pressed through the conduit 5 into the chamber part 1*a* and the piston is moved in opposite direction to that of the arrow A.

I claim:

1. A device for applying flowing masses, such as pastes or viscous liquids, to the surface of a workpiece, comprising a hollow chamber containing the mass, a conduit for conveying said mass to said hollow chamber and an outlet in said hollow chamber turned to the surface of the workpiece, wherein: a piston (2) having passages therethrough is arranged in the hollow chamber (1), through the front side (2*a*) of which piston (2) the mass is forced toward the outlet (6), the front side (2*a*) of the piston is parallel to the outlet (6), the surface of the outlet (6) is subdivided into several openings (6*a*) and slots; and said conduit (5) conveying the mass is formed by a longitudinal boring in piston rod (3) and transverse borings (8) are arranged in the piston rod (3) adjacent the rear side (2b) of the piston (2), said borings (8) connecting the longitudinal boring to that part (1*a*) of the chamber which is positioned on the rear side of the piston, said hollow chamber containing only said piston, a portion of said piston rod, and said mass.

2. A device according to claim 1, wherein: said piston (2) is formed of a plate which is perforated in the form of a sieve.

3. A device according to claim 1, wherein: the passages are arranged in side surfaces of said piston.

4. A device according to claim 1, wherein: a material, which is permeable to the mass, in particular a fabric or sieve (7), is arranged in the outlet (6).

5. A device according to claim 1, wherein: chamber (1) has a height (H) less than the latter's largest diameter 6. A device according to claim 1, wherein: the piston (2) and the chamber (1) have a rectangular cross-section corresponding to each other.

* * * * *